United States Patent [19]

Colliander

[11] Patent Number: 4,538,380

[45] Date of Patent: Sep. 3, 1985

[54] LOW FRICTION WEATHER SEAL

[75] Inventor: Alan C. Colliander, Hastings, Minn.

[73] Assignee: Profile Extrusions Company, Hastings, Minn.

[21] Appl. No.: 552,286

[22] Filed: Nov. 16, 1983

[51] Int. Cl.[3] ..... E06B 7/16

[52] U.S. Cl. ..... 49/475; 49/490; 49/489; 49/497

[58] Field of Search ..... 49/497, 498, 489, 475, 49/490, 440, 441; 156/279

[56] References Cited

U.S. PATENT DOCUMENTS

| | | | |
|---|---|---|---|
| 3,385,001 | 5/1968 | Bordner | 49/497 X |
| 3,448,543 | 6/1969 | Multer | 49/498 X |
| 3,535,824 | 10/1970 | Kessler | 49/489 X |
| 3,685,206 | 8/1972 | Kessler | 156/279 X |
| 3,918,206 | 11/1975 | Dochnahl | 49/441 |
| 4,075,851 | 2/1978 | Gardner | 49/475 X |
| 4,305,984 | 12/1981 | Boyce | 49/489 X |
| 4,358,497 | 11/1982 | Miska | 49/475 |

OTHER PUBLICATIONS

Applicant Exhibits A and B submitted Feb. 6, 1984.

*Primary Examiner*—Philip C. Kannan

*Attorney, Agent, or Firm*—Merchant, Gould, Smith, Edell, Welter & Schmidt

[57] ABSTRACT

An extruded, low friction weather seal is disclosed which in transverse cross section consists of a semirigid base member of polypropylene, a tubular sealing member of thermoplastic elastomer, and a thin film of polypropylene or a blend of polypropylene and thermoplastic elastomer capping all or part of the tubular sealing member. The thermoplastic elastomer enables the tubular sealing member to be resilient and compliant over a wide range of temperatures, including extremely cold conditions, but has a high friction surface which is subject to wear particularly where there is relative sliding movement between the weather seal and surface to be sealed. The polypropylene thin film cap provides a low friction contact surface without adversely affecting the resilience and compliance of the tubular sealing member.

21 Claims, 6 Drawing Figures

LOW FRICTION WEATHER SEAL

FIELD OF THE INVENTION

The invention generally relates to weather seals for doors, windows and the like, and is specifically directed to an improved resilient and compliant weather seal having a low friction contact surface.

BACKGROUND OF THE INVENTION

Weather seals for windows, doors and the like perform a highly useful function by conserving energy, avoiding drafts and maintaining uniform inside temperatures through the avoidance of heat loss. The weather seal is typically used between stationary and movable members; e.g., between a window frame and movable window.

To effect a proper seal over an entire area of contact, the weather seal should be both resilient and compliant. This avoids any potential problem with rough, irregular or uneven surfaces between the seal and the surface which it contacts.

Resilient weather seals are in common use today and are fabricated from a variety of materials, including foamed or cellular natural and synthetic materials, rubber or rubberized materials, vinyl-clad materials and resilient plastics.

One of the most useful weather seal materials are thermoplastic elastomers due to their high degree of resilience and compliance which is maintained over an extremely broad range of ambient temperatures. This range of temperatures encompasses the lowest outside winter temperatures to which we are exposed even in the coldest climates. Materials which do not have this advantageous characteristic become hard and brittle at lower temperatures, losing resilience and compliance and often times cracking or even breaking.

However, thermoplastic elastomers are not without disadvantages when used for weather seals. The material itself has a relatively high coefficient of static and dynamic friction, and as a result it is not generally suitable for applications where sliding movement takes place between stationary and movable members (e.g., sliding doors or hinged casement windows in which there is a wiping action). In applications such as these, the relative sliding movement between the weather seal and contact surface, which itself may also exhibit a high friction characteristic, will result in rapid wear and less than optimum operation (e.g., difficulty in closing the door or window).

Prior art structures have attempted to solve this problem in different ways. As an example, one structure utilizes a foamed, cellular core which is provided with an internal stiffener for purposes of strength in installation, and is then wrapped completely in a layer of vinyl. This composite structure provides good sealing capability at intermediate and higher temperatures, but the external vinyl layer becomes hard and brittle at lower temperatures. Under these circumstances, it loses its resilience and compliance, and at best it loses its capability to properly seal. At worst, the vinyl cracks or breaks, and as a result the device fails and must be replaced.

Equally as important due to its composite structure, the vinyl-clad weather seal is both difficult and expensive to manufacture, resulting in a higher cost to the ultimate consumer.

A second approach to the problem is evidenced in U.S. Pat. No. 3,385,001. The weather seal disclosed in this patent utilizes a rigid mounting section, a rigid rub strip spaced from the mounting section and a resiliently flexible diaphragm section disposed therebetween and joining the two. The rub strip is of a material such as polyvinylchloride, which has a relatively low coefficient of friction. However, the rub strip is necessarily rigid to perform its intended function, and as a result it has no resilience or compliance to effect a proper seal where irregular or rough surfaces are encountered.

SUMMARY OF THE INVENTION

The subject invention is the result of an endeavor to provide a weather seal from a material such as a thermoplastic elastomer, so that resilience and compliance are maintained even at very cold ambient temperatures, while offering a low friction characteristic between the weather seal and the surface which it contacts to effect the seal.

The invention broadly resides in a weather seal comprising an elongated base member which is at least semi-rigid for mounting purposes, a sealing member carried by the base member and extending over its length and having resilience over a wide range of temperatures, and a thin film capping at least part of the sealing member in the area of exposure to the contact surface. The thin film is of a material having a relatively low coefficient of friction, and it is sufficiently thin so that it does not adversely affect the resilience of the sealing member.

In the preferred embodiment, the base member is formed from polypropylene and includes an outwardly projecting leg member extending over its length which is insertable into a mounting groove in either the stationary or movable member. The sealing member is formed from a thermoplastic elastomer and takes the form of an elongated hollow tube. The invention is also applicable to sealing members taking the form of leaf seals or other configurations. The thin film is preferably polypropylene in its entirety, or a blend of polypropylene and a thermoplastic elastomer. The thin film may encapsulate the entirety of the external surface of the hollow tube, or it may also serve as a partial cap for only that portion of the external tube surface that is engaged. It is also possible to provide a plurality of longitudinally extending ribs of the thin film in the area of sealing engagement.

Preferably, the components of the weather seal are integrally formed in a single extrusion. As a result, the weather seal is structurally simple, and easily and less expensively manufactured.

The inventive weather seal offers a combination of advantages not heretofore possible with prior art structures. It offers the requisite resiliency and compliance with decreased surface friction in a simple integrated structure that may be fabricated as a single extrusion. Where a material such as a thermoplastic elastomer is used for the sealing member, the thin film cap provides for less tackiness at high as well as low temperatures. The improved weather seal wears better and thus lasts longer without replacement. It has a much lower paint adhesion, which not only simplifies painting the surrounding components, but also reduces the possibility of paint adhering to the seal and adversely affecting the sealing function.

In addition, the improved weather seal has an improved resistance to water and/or air filtration and transmission. It has an increased tear resistance and an increased resistance to chemicals such as pentachlorophenol, which is commonly used as a wood preservative for wood windows.

The inventive wear seal has better long-term flexibility, high integrated strength, avoids age hardening and reduces stretch during installation. Last, it has better color retention, and although it is fabricated as a single extrusion in the preferred embodiment, it is possible to include multiple colors.

DESCRIPTION OF THE PREFERRED EMBODIMENTS

Figure 1:
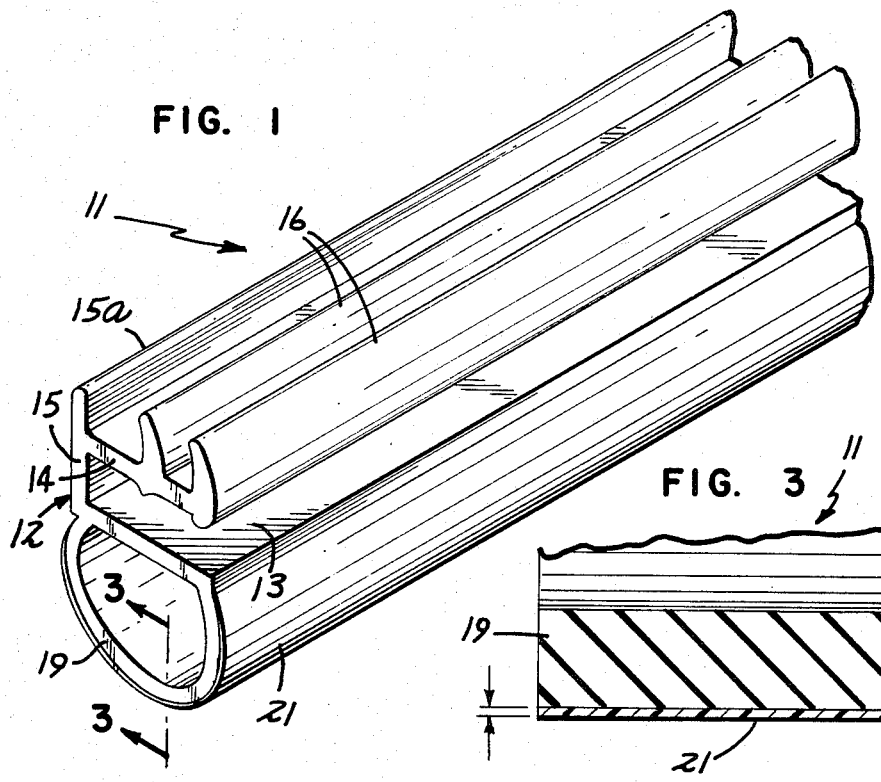
FIG. 1 is a perspective fragmentary view of one embodiment of a weather seal embodying the invention.
Figure 3:
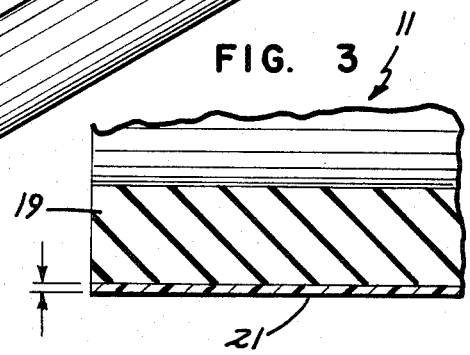
FIG. 3 is a fragmentary view in side elevation of the inventive weather seal.
Figure 2:
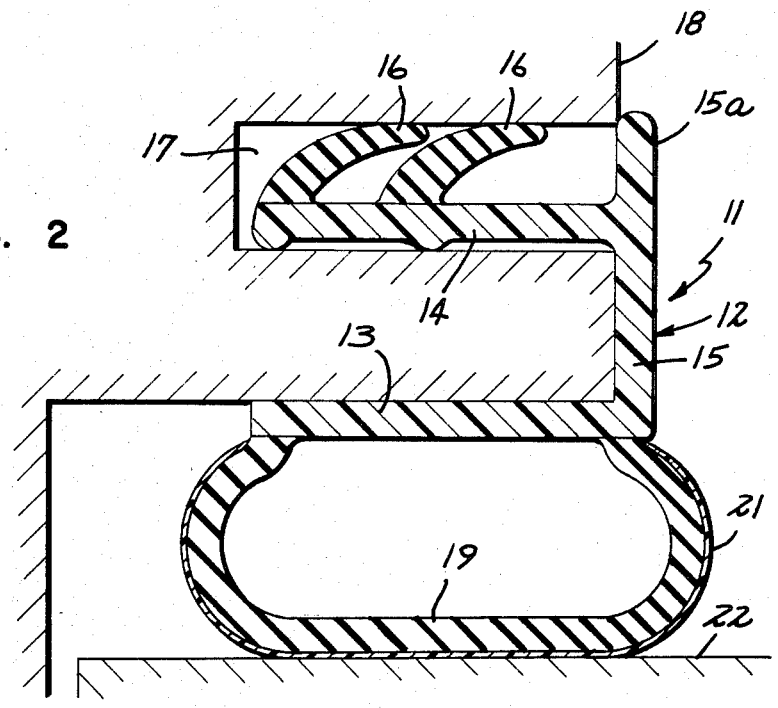
FIG. 2 is an enlarged transverse sectional view of the inventive weather seal in an operating environment.

With initial reference to FIGS. 1–3, one embodiment of an inventive weather seal is represented generally by the numeral 11. Weather seal 11 comprises a base member 12 formed from material which is at least semirigid. This material is preferably an extrudable polymer such as a polyolefin homopolymer or copolymer and in the preferred embodiment is polypropylene.

As shown in FIGS. 1 and 2, the base member 12 is configured as a channel section, comprising opposed parallel sides 13, 14 and an interconnecting web 15 having an extension 15a that projects beyond the juncture with side 14.

Projecting outwardly from the outer surface of side 14 are two barb members 16 that in the preferred embodiment are formed from material which is somewhat resilient as distinguished from the semirigidity of base member 12. As shown in FIG. 2, the side 14 constitutes a projecting leg that is insertable into a mounting groove 17 formed in a stationary member 18 which may be a window or door. The barb members 16 permits insertion of the side 14 into the mounting groove 17, but resist withdrawal due to friction. The extension 15a is dimensioned to overlie the mouth of the mounting groove 17.

With continued reference to FIGS. 1 and 2, a sealing member 19 taking the form of an elongated hollow tube is carried by the external surface of the side 13 of base 12. The sealing member 19 extends continuously over the length of base 12 and is formed from material that is resilient and compliant over a wide range of outside temperatures. In the preferred embodiment, sealing member 19 is formed from a thermoplastic elastomer that exhibits the characteristics of resilience and compliance not only at high temperatures but as low as −70 degrees Fahrenheit. The thermoplastic elastomer used has a relatively high coefficient of static and dynamic friction.

With continued reference to FIGS. 1 and 2, the improved weather seal further comprises a thin film 21 that encapsulates the entirety of the external exposed surface of tubular sealing member 19. Thin film 21 is formed from material having a coefficient of friction which is less than that of the tubular sealing member 19, and it is sufficiently thin as to permit resilient flexure with the sealing member 19. In other words, the thin film 21 presents a low friction characteristic to the surface which it sealably engages (e.g., a window 22 as shown in FIG. 2), but it does not prevent sealing member 19 from being resilient and compliant when engaged by the window 22.

Thin film 21 is preferably formed in its entirety from an extrudable polymer with the desired low friction characteristic, or blended with another material. Preferably, thin film 21 is formed in its entirety from polypropylene, or from a blend of polypropylene and a thermoplastic elastomer of no more than fifty percent of the latter. Blending a thermoplastic elastomer with polypropylene for the thin film 21 obtains optimum resilience and compliance with a relatively low friction characteristic, while at the same time providing a good merger with the thermoplastic elastomer sealing member 19.

With reference to FIGS. 2 and 3, the sealing member 19 is of predetermined wall thickness, and the thin film 21 has a thickness of about 5%–30% of this predetermined wall thickness. In the preferred embodiment, the thickness of the thin film 21 is on the order of 0.001–0.003 inches.

With the foregoing selection of materials for its several components, the weather seal 11 may be integrally formed in a single extrusion of continuous length, and thereafter cut to desired finite lengths.

Figure 4:
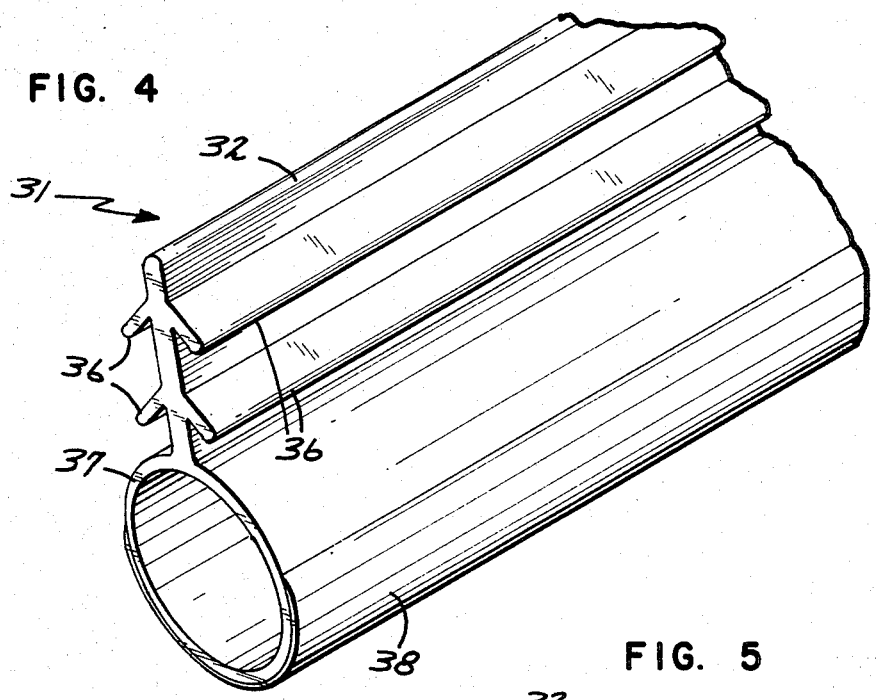
FIG. 4 is a fragmentary perspective view of an alternative embodiment of the inventive weather seal.
Figure 5:
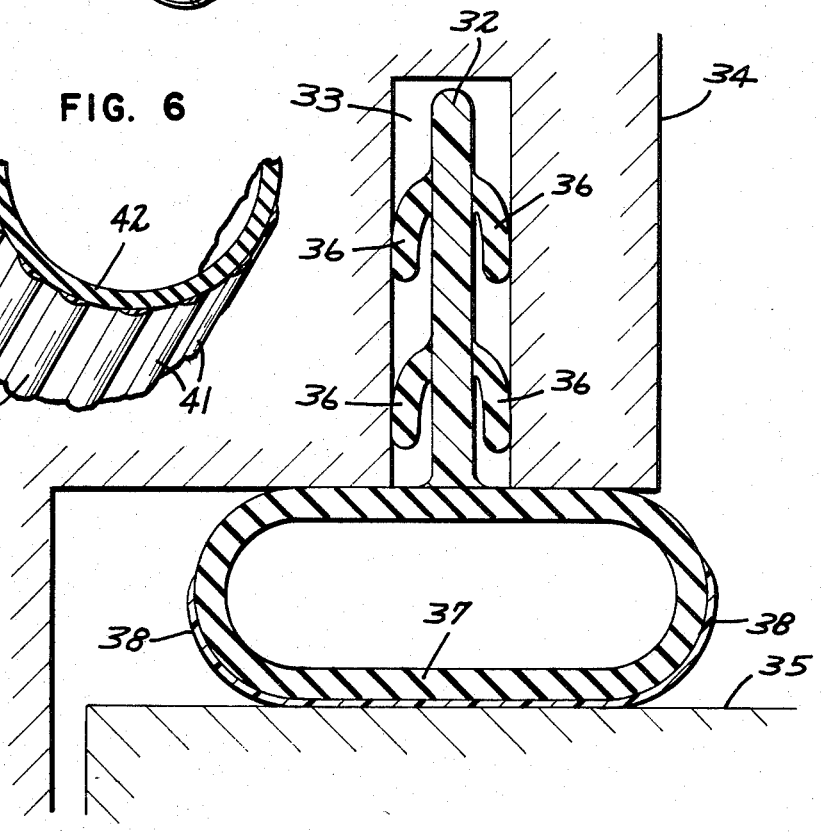
FIG. 5 is an enlarged transverse sectional view of the alternative embodiment in an operating environment.

FIGS. 4 and 5 show an alternative embodiment of the inventive weather seal which is represented generally by the numeral 31. Weather seal 31 comprises a base member 32 of at least semirigid material which is configured as a single, longitudinally extending leg suitable for insertion into a mounting groove 33 of a stationary member 34 such as a window frame or door jam. A door or window 35 slides or wipes relative to the stationary member 34. It will be appreciated that the mounting groove 33 and weather seal 31 can be on the movable member 35 rather than the stationary member 34.

Base member 32 includes two barb members 36 projecting outwardly from each side which are angled to permit entry of the base member 32 into the groove 33 while frictionally resisting its withdrawal. As with weather seal 11, the base member 32 is preferably polypropylene, and the barbs 36 are formed from a resilient material such as thermoplastic elastomer, although they could be formed from semirigid or rigid materials as well.

A sealing member 37 taking the form of an elongated hollow tube is carried by the base member 32 in such a way that the member 32 projects outward along a radius of the tube. The sealing member 37 is resilient and compliant, and is preferably formed from a thermoplastic elastomer.

A thin film 38 caps approximately the lower half of the sealing member 37 and extends over its entire length. Capping the sealing member 37 in this manner provides the low friction characteristic needed for engagement with the door or window 35, but also permits increased flexure in the region which is not capped.

As in the primary embodiment of FIGS. 1–3, thin film 38 is preferably formed in its entirety from polypropylene, or from a blend of polypropylene and up to 50% of a thermoplastic elastomer.

It is also preferred that the various components of the weather seal be made from materials that are extrudable, thus permitting the weather seal 31 to be integrally formed in a single extrusion.

Figure 6:
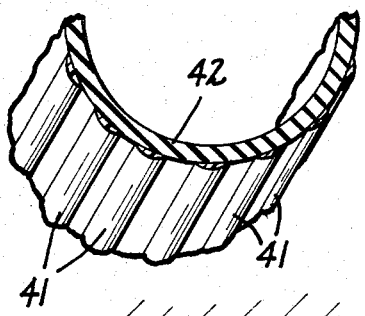
FIG. 6 is a detailed fragmentary view in perspective of a further alternative embodiment of the inventive weather seal.

The embodiment of FIGS. 4 and 5 demonstrates that the thin film 38 need not encapsulate the entire sealing member 37 to provide the desired low friction characteristic. In the further alternative embodiment shown in FIG. 6, the thin film takes the form of a plurality of thin, longitudinally extending ribs 41 that are coextruded with a thermoplastic elastomer sealing member 42 of tubular configuration. The ribs 41 are spaced uniformly from each other, and they may be distributed over the entire outer surface of sealing member 42, or over only a part thereof as in the embodiment of FIGS. 4 and 5.

Other configurations of the thin, low friction film are possible, so long as a substantially continuous, relatively low friction surface is presented for sliding or other movable engagement without obviating the necessary resilience and compliance of the sealing member.

It will be appreciated from the foregoing that the inventive weather seal performs its sealing function over a wide range of ambient temperatures, retaining resilience and compliance for a proper seal, while at the same time presenting a relatively low friction sur- face.

What is claimed is:

1. A weather seal for windows, doors and the like, comprising:

an elongated base member the dimensions and material of which cause it to be at least semirigid;

a sealing member carried by the base member and extending over its length, the sealing member being formed from material that is resilient and compliant over a wide range of outside temperatures and having a predetermined coefficient of friction;

and a thin continuous film capping at least a part of the sealing member and extending over its length, the thin film being formed with a substantially uniform thickness from a material having a coefficient of friction which is less than that of the sealing member, and being sufficiently thin to permit resilient and compliant flexure with said sealing member.

2. The weather seal defined by claim 1, wherein the material of said base member is an extrudable polymer.

3. The weather seal defined by claim 2, wherein said extrudable polymer is polyolefin homopolymer or copolymer.

4. The weather seal defined by claim 2, wherein said extrudable polymer is polypropylene.

5. The weather seal defined by claim 1, wherein the sealing member is formed from a thermoplastic elastomer.

6. The weather seal defined by claim 5, wherein the thin film comprises a polyolefin at least in part.

7. The weather seal defined by claim 6, wherein the polyolefin is polypropylene.

8. The weather seal defined by claim 7, wherein the thin film comprises a blend of polyolefin and thermoplastic elastomer.

9. The weather seal defined by claim 7, wherein the thin film comprises a blend of polypropylene and thermoplastic elastomer.

10. The weather seal defined by claim 1, wherein the base member is polypropylene, the sealing member is thermoplastic elastomer, and the thin film is a blend of polypropylene and thermoplastic elastomer.

11. The weather seal defined by claim 1 or 10, wherein the base member, sealing member and thin film comprise an integral single extrusion.

12. The weather seal defined by claim 1, wherein the sealing member comprises a hollow tube.

13. The weather seal defined by claim 12, wherein the thin film totally encapsulates the outer surface of the hollow tube.

14. The weather seal defined by claim 12, wherein the thin film caps approximately one-half of the outer surface of the hollow tube.

15. The weather seal defined by claim 1, wherein the sealing member is of predetermined wall thickness and the thin film has a thickness of about 5%–30% of said predetermined wall thickness.

16. The weather seal defined by claim 1, wherein the thickness of the thin film is on the order of 0.001-0.003 inches.

17. A weather seal for windows, doors and the like, comprising:

a base member of extrudable polyolefin homopolymer or copolymer having a laterally projecting leg extending over its length of sufficient rigidity as to permit insertion into a mounting groove;

a tubular sealing member carried by the base member and formed from an extrudable thermoplastic elastomer that is resilient and compliant over a wide range of outside temperatures and having a predetermined coefficient of friction;

and a thin continuous film formed at least in part of an extrudable polyolefin homopolymer or copolymer having a coefficient of friction which is less that that of the thermoplastic elastomer, the thin film being of substantially uniform thickness but sufficiently thin to permit resilient and compliant flexure with said sealing member;

said base member, sealing member and thin film being integrally formed in a single extrusion.

18. The weather seal defined by claim 17, wherein the polyolefin homopolymer or copolymer is polypropylene.

19. The weather seal defined by claim 17, wherein the thin film totally encapsulates the outer surface of the tubular sealing member.

20. The weather seal defined by claim 17, wherein the thin film caps approximately one-half of the outer surface of the tubular sealing member.

21. A weather seal for windows, doors and the like, comprising:

an elongated base member the dimensions and material of which cause it to be at least semirigid;

a sealing member carried by the base member and extending over its length, the sealing member being formed from material that is resilient and compliant over a wide range of outside temperatures and having a predetermined coefficient of friction;

and a thin continuous film coextruded with the ceiling member and capping at least a part thereof, the thin film being formed from a material having a coefficient of friction which is less than that of the sealing member, and being sufficiently thin to permit resilient and compliant flexure with said sealing member.

* * * * *